United States Patent [19]

Linhart et al.

[11] Patent Number: 4,780,597

[45] Date of Patent: Oct. 25, 1988

[54] ELECTRICAL BAKING AND ROASTING OVEN

[75] Inventors: Gudrun Linhart, Nürnberg; Richard Turek, Fürth; Werner Küfner, Nurnberg; Roland Kelchner, Zirndorf, all of Fed. Rep. of Germany

[73] Assignee: Licentia Patent-Verwaltungs GmbH, Frankfurt, Fed. Rep. of Germany

[21] Appl. No.: 64,128

[22] Filed: Jun. 17, 1987

[30] Foreign Application Priority Data

Jul. 18, 1986 [DE] Fed. Rep. of Germany ..... 3624426
Jul. 18, 1986 [DE] Fed. Rep. of Germany ... 8619391[U]

[51] Int. Cl.[4] ..... H05B 3/22

[52] U.S. Cl. ..... 219/404; 219/396; 219/521; 219/403

[58] Field of Search ..... 219/402, 403, 404, 395, 219/396, 385, 386, 387, 390, 521

[56] References Cited

U.S. PATENT DOCUMENTS

| | | | |
|---|---|---|---|
| 424,922 | 4/1890 | Capek | 219/404 |
| 1,376,829 | 5/1921 | Phelps | 219/403 |
| 2,893,307 | 7/1959 | Rodrigues | 219/404 |
| 2,994,760 | 8/1961 | Pecoraro | 219/400 |
| 3,196,252 | 7/1965 | Weingrad | 219/403 |
| 3,238,863 | 3/1966 | Beasley | 219/404 |
| 3,241,543 | 3/1966 | Hirsch | 219/404 |
| 4,029,936 | 6/1977 | Schweitzer | 219/267 |
| 4,503,319 | 3/1985 | Moritoki | 219/390 |

FOREIGN PATENT DOCUMENTS

| | | | |
|---|---|---|---|
| 3246445 | 6/1984 | Fed. Rep. of Germany . | |
| 903438 | 10/1945 | France | 219/395 |
| 600388 | 4/1948 | United Kingdom | 219/404 |

*Primary Examiner*—E. A. Goldberg
*Assistant Examiner*—Teresa J. Walberg
*Attorney, Agent, or Firm*—Spencer & Frank

[57] ABSTRACT

An electrical baking and roasting oven defining a cooking chamber which can be closed by a door, the oven having side walls bounding the cooking chamber and the oven being composed of an upper heating element and a lower heating element for heating upper and lower regions, respectively, of the chamber, an insertable partitioning member carraying the lower heating element and equipped with a plug-in connection, for partitioning off a lower part of the volume of the cooking chamber, and guide elements mounted on the side walls for supporting the partitioning member, wherein the partitioning member includes a heat insulating body disposed below the lower heating element for thermally shielding the lower part of the cooking chamber, and the oven side walls are provided with breaks at the height of the guide elements for reducing thermal conduction through the side walls to the lower part of the cooking chamber.

8 Claims, 1 Drawing Sheet

ELECTRICAL BAKING AND ROASTING OVEN

BACKGROUND OF THE INVENTION

The present invention relates to an electrical baking and roasting oven having upper and lower heating elements.

FRG-OS No. 3,246,445 discloses a baking and roasting oven of this type. In this prior art baking and roasting oven, the amount of heating energy consumed is to be reduced by the provision of an insertable plug-in member having an integrated heating element so as to partition off part of the cooking area of the oven. However, it has been found that the insertable member radiates and dissipates a large amount of heat and, moreover, heat conduction through the walls of the cooking chamber heats the cooking region disposed below the insertable member to approximately the same temperature as the cooking region disposed thereabove. Since now, in a partitioned cooking chamber which is heated at the bottom and the top only the upper cooking region is used and loaded with food to be baked or roasted, the lower cooking region, which is inevitably heated up as well, remains unused and the heat conducted thereto by radiation or heat conduction is lost without being used.

SUMMARY OF THE INVENTION

It is therefore an object of the present invention to overcome this drawback and to ensure that, with a reduction in size of the cooking chamber, the part of the cooking chamber not in use will not unnecessarily be heated up as well.

The above and other objects are achieved, according to the invention, in an electrical baking and roasting oven defining a cooking chamber which can be closed by a door, the oven having side walls bounding the cooking chamber and the oven comprising an upper heating element and a lower heating element for heating upper and lower regions, respectively, of the chamber, an insertable partitioning member carrying the lower heating element and equipped with a plug-in connection, for partitioning off a lower part of the volume of the cooking chamber, and guide means mounted on the side walls for supporting the partitioning member, by the improvement wherein: the partitioning member comprises heat insulating means disposed below the lower heating element for thermally shielding the lower part of the cooking chamber; and the oven side walls are provided with breaks at the height of the guide means for reducing thermal conduction through the side walls to the lower part of the cooking chamber.

One of the advantages realized with the invention is that a reduction of the effective cooking chamber area also results in a considerable savings of heating energy since essentially no heat is supplied to the unused portion of the cooking chamber.

Embodiments of the invention are illustrated in the drawing and will be described in greater detail below with reference thereto.

DESCRIPTION OF THE PREFERRED EMBODIMENTS

Figure 1:
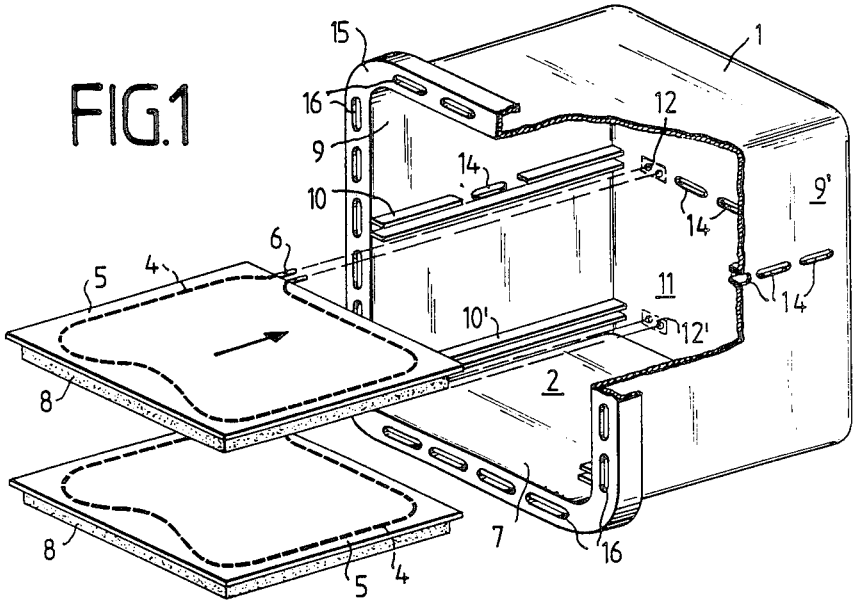
FIG. 1 is an isometric view of one embodiment of a baking and roasting oven muffle, or liner, of an electrical baking and roasting oven having a heated insertable member according to the invention.
Figure 2:
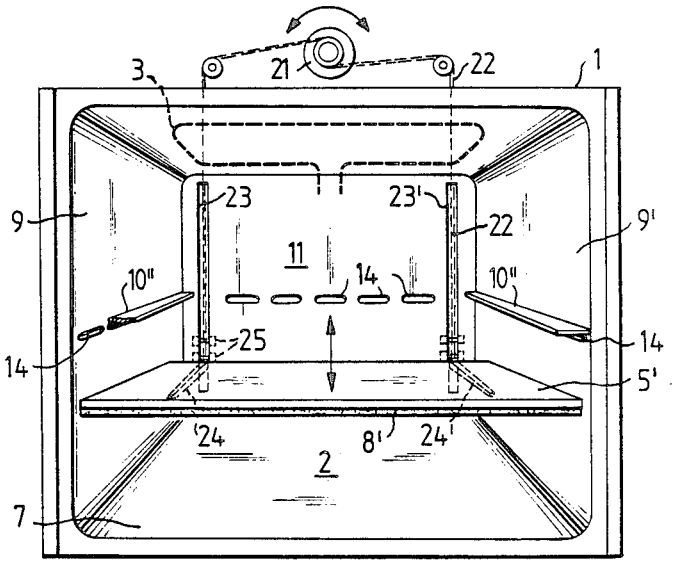
FIG. 2 is a front perspective view of an embodiment of the baking and roasting oven muffle including a device for automatically adjusting the height of the insertable cooking chamber partitioning member.

The baking oven muffle 1 shown in FIGS. 1 and 2 for an electrical baking and roasting oven defines a cooking chamber 2 which can be closed by a door (not shown). Muffle 1 is provided, in the upper cooking chamber region, below the ceiling of muffle 1, with an upper electrical heating element 3, and in the lower region, above bottom 7, with a lower heating element 4.

Lower element 4 for the bottom heat is advantageously integrated into a plate-like insertable partitioning member 5 which is provided with electrical plug-in contacts 6 for supplying current to heating element 4. With the aid of this insertable member 5, there now exists the possibility of partitioning the volume of the cooking chamber 2 so that a smaller cooking chamber section is available for smaller baking and roasting quantities, with this smaller area being heated in an energy saving manner. Moreover, only this cooking chamber section which is partitioned off from the actual cooking chamber 2 is then soiled while the remaining portion of the cooking chamber remains clean.

The heating element 4, integrated in insertable member 5, is, according to the invention, shielded from the bottom 7 of cooking chamber 2 by means of a highly temperature resistant heat insulation plate 8 so that the heat radiated heating element 4 is forced upwardly in the direction toward the ceiling of muffle 1. In the interior of oven muffle 1, at its side walls 9, 9', guide rails 10, 10' are provided at different heights for insertable member 5. At the corresponding height positions, electrical sockets 12, 12' are provided at rear wall 11 of muffle 1 for the electrical plug-in contacts 6 provided at insertable member 5. These sockets are in communication, via electrical connecting lines, with the setting and switching members of the baking and roasting oven.

To substantially prevent the conduction of heat via walls 9, 9' during use of the upper cooking chamber section, when insertable member 5 rests on the upper guide rails 10, into the unused cooking chamber section disposed below insertable member 5, breaks, or openings, 14 are provided in side walls 9, 9' and possibly also in rear wall 11 at the height of the upper guide 10 for insertable member 5. These breaks 14 are designed as a slotted bar arrangement extending in a horizontal plane.

The lateral breaks 14 are advantageously enclosed by guide rails 10 for insertable member 5 so that they are practically invisible from the front for the user of cooking chamber 2.

It is advisable to attach guide rails 10 only at several spaced points in side walls 9, 9' so as to reduce heat conduction and heat transfer at these locations.

Advisably, heat insulation is placed in the customary manner around the outer wall of muffle 1 and this insulation also covers the breaks 14 in the muffle walls toward the exterior. It is further of advantage to also provide the front frame 15 of oven muffle 1 with slit-like breaks 16 to thus even further prevent the conduction of heat from the upper cooking chamber section to the lower cooking chamber section.

According to a further embodiment of the invention, shown in FIG. 2, an insertable cooking chamber partitioning member 5' is brought, not manually but automatically, into the cooking chamber partitioning position by means of a height adjustment device. The height adjustment device is here operated electrically and is actuated by means of an appropriate member. The above-mentioned device is composed of a direct current motor 21 able to rotate clockwise and counterclockwise. This motor raises or lowers cooking chamber partitioning member 5' by way of a pulley arangement 22, guide channels or rails 23, 23' and angle supports 24, 24' for cooking chamber partitioning member 5'. Supports 24, 24' are supported and guided along guide channels or rails 23, 23' by means of supporting and slide rollers 25 mounted on supports 24, 24'. Lateral guide rails 10'' here serve as height limiting abutments for cooking chamber partitioning member 5'. The baking oven muffle 1 shown in FIG. 2 has at the height of the guide means 10'' breaks, or openings 14 in the side walls 9, 9' and also in rear wall 11 of the same manner like the oven muffle 1 which shown in FIG. 1. The breaks or openings 14 are advantageously enclosed by guide rails 10'' for the partitioning member 5' so that they are practically invisible from the front for the user of cooking chamber 2. The cooking chamber partitioning member 5' has a highly temperature resistant heat insulation plate 8' too.

The invention now being fully described, it will be apparent to one of ordinary skill in the art that many changes and modifications can be made thereto without departing from the spirit or scope of the invention as set forth herein.

What is claimed:

1. In an electrical baking and roasting oven defining a cooking chamber which can be closed by a door, the oven having side walls bounding the cooking chamber and the oven comprising an upper heating element and a lower heating element for heating upper and lower regions, respectively, of the chamber, an insertable partitioning member carrying the lower heating element and equipped with a plug-in connection, for partitioning off a lower part of the volume of the cooking chamber, and guide means mounted on the side walls for supporting the partitioning member, the improvement wherein: said partitioning member comprisies heat insulating means disposed below said lower heating element for thermally shielding the lower part of said cooking chamber; and said oven side walls are provided with breaks at the height of said guide means for reducing thermal conduction through said side walls to the lower part of said cooking chamber.

2. An oven as defined in claim 1 wherein said oven further has a rear wall bounding said cooking chamber and provided with breaks at the height of said guide means.

3. An oven as defined in claim 1 wherein said breaks in each said side wall have the form of a slotted bar portion which extends in a horizontal plane.

4. An oven as defined in claim 1 wherein said breaks are enclosed by said guide means.

5. An oven as defined in claim 4 wherein said guide means contact said side walls only at isolated points.

6. An oven as defined in claim 1 wherein said oven has a front frame surrounding a door opening and said front frame is provided with breaks in the form of slits.

7. An oven as defined in claim 1 further comprising an electrically operated height adjusting device connected to said partitioning member for adjusting the height of said partitioning member in said chamber.

8. An oven as defined in claim 7 wherein said height adjustment device comprises a bidirectionally rotatable direct current motor, guide means in said chamber for guiding the movement of said partitioning member, and pulley means connected between said motor and said partitioning member.

* * * * *